US008412078B2

(12) United States Patent
Nishiwaki

(10) Patent No.: US 8,412,078 B2
(45) Date of Patent: Apr. 2, 2013

(54) DEVELOPMENT AGENT SUPPLY DEVICE INCLUDING AN ELECTRIC-FIELD TRANSFER BOARD AND A DEVELOPMENT AGENT RETRIEVING UNIT AND IMAGE FORMING APPARATUS HAVING THE SAME

(75) Inventor: Kenjiro Nishiwaki, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 226 days.

(21) Appl. No.: 12/893,467

(22) Filed: Sep. 29, 2010

(65) Prior Publication Data

US 2011/0158696 A1 Jun. 30, 2011

(30) Foreign Application Priority Data

Dec. 24, 2009 (JP) ..... 2009-291674

(51) Int. Cl.
*G03G 15/08* (2006.01)

(52) U.S. Cl. ..... 399/254

(58) Field of Classification Search ..... 399/254, 399/88, 262, 281

See application file for complete search history.

(56) References Cited

U.S. PATENT DOCUMENTS

| | | | | |
|---|---|---|---|---|
| 5,027,157 | A | 6/1991 | Hotomi et al. | |
| 5,142,336 | A | 8/1992 | Hotomi et al. | |
| 2003/0210928 | A1 | 11/2003 | Miyaguchi et al. | |
| 2005/0152717 | A1 | 7/2005 | Miyaguchi et al. | |
| 2009/0080942 | A1* | 3/2009 | Nishiwaki et al. | 399/254 |
| 2009/0175662 | A1 | 7/2009 | Nishiwaki | |
| 2009/0238611 | A1 | 9/2009 | Hazeyama | |
| 2009/0297228 | A1 | 12/2009 | Maeda et al. | |
| 2010/0247134 | A1* | 9/2010 | Maeda | 399/88 |
| 2010/0247161 | A1* | 9/2010 | Hattori | 399/262 |
| 2010/0316418 | A1* | 12/2010 | Sato et al. | 399/281 |
| 2011/0158706 | A1* | 6/2011 | Nishiwaki | 399/281 |

FOREIGN PATENT DOCUMENTS

| | | |
|---|---|---|
| JP | HEI 2-151884 | 6/1990 |
| JP | HEI 2-160266 | 6/1990 |
| JP | HEI 3-12678 | 1/1991 |
| JP | 2002-287495 | 10/2002 |
| JP | 2003-265982 | 9/2003 |
| JP | 2004-69903 | 3/2004 |
| JP | 2008-70803 | 3/2008 |
| JP | 2009-3307 | 1/2009 |

(Continued)

OTHER PUBLICATIONS

Translation of JP2009-003307A to Hattori, Jan. 2009.*

*Primary Examiner* — Quana M Grainger
(74) *Attorney, Agent, or Firm* — Scully, Scott, Murphy & Presser, PC

(57) ABSTRACT

A development agent supply device includes a casing having an opening, a first development agent storage section, and a second development agent storage section, a development agent holding member housed in the casing such that a development agent holding surface thereof faces a developer-supplied device via the opening, a first electric-field transfer board that transfers development agent with a traveling-wave electric field along a down-facing development agent transfer surface in a predetermined direction from the first development agent storage section to the opening and faces the development agent holding surface at a downstream end in the predetermined direction, and a development agent retrieving unit that agitates development agent stored in the second development agent storage section and inadequately-charged development agent falling from the development agent transfer surface and conveys the development agent to the first development agent storage section.

16 Claims, 1 Drawing Sheet

1

FOREIGN PATENT DOCUMENTS

| | | | | |
|---|---|---|---|---|
| JP | 2009003212 | A | * | 1/2009 |
| JP | 2009003307 | A | * | 1/2009 |
| JP | 2009-63949 | | | 3/2009 |
| JP | 2009-229674 | | | 10/2009 |
| WO | WO 2008/066015 | A1 | | 6/2008 |

* cited by examiner

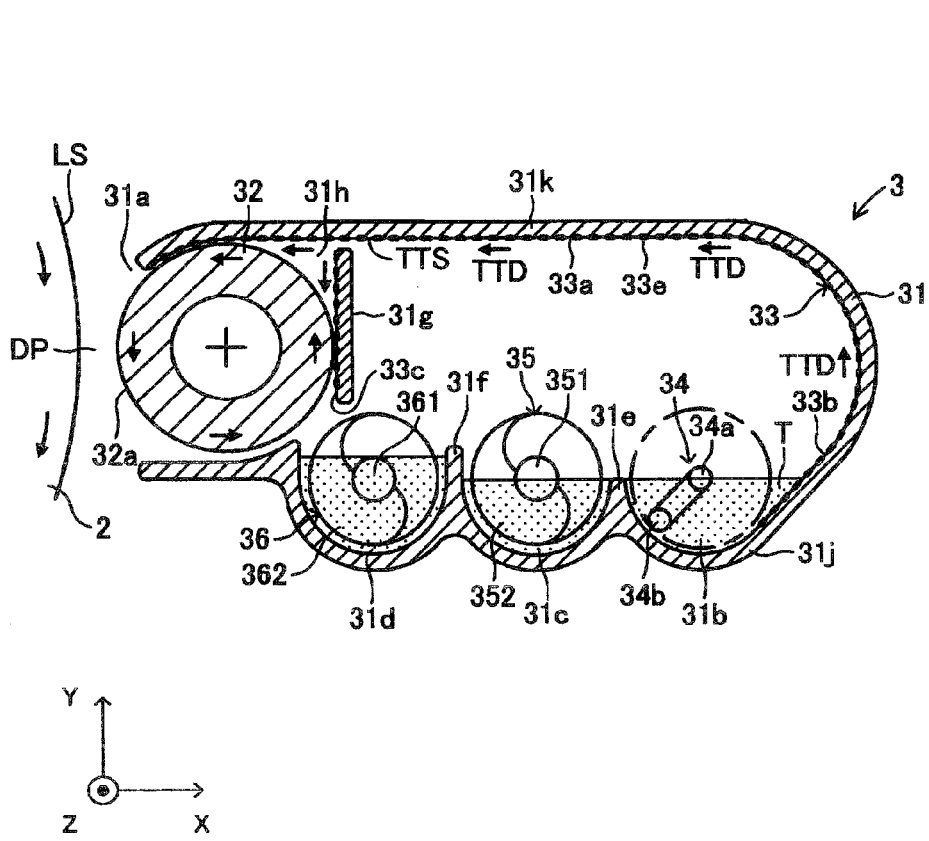
1
LS
31a
32
31h
31k
3
TTS
TTD
33a
33e
TTD
31
33
31g
DP
33c
35
351
31f
361
34
TTD
33b
31e
34a
T
32a
2
36
362
31d
352
31c
34b
31b
31j
Y
Z
X

DEVELOPMENT AGENT SUPPLY DEVICE INCLUDING AN ELECTRIC-FIELD TRANSFER BOARD AND A DEVELOPMENT AGENT RETRIEVING UNIT AND IMAGE FORMING APPARATUS HAVING THE SAME

CROSS-REFERENCE TO RELATED APPLICATION

This application claims priority under 35 U.S.C. §119 from Japanese Patent Application No. 2009-291674 filed on Dec. 24, 2009. The entire subject matter of the application is incorporated herein by reference.

BACKGROUND

1. Technical Field

The following description relates to one or more development agent supply devices configured to supply charged development agent to an intended device.

2. Related Art

A development agent supply device has been known that includes a development agent holding member (a development roller), an upstream development agent transfer unit, and a downstream development agent transfer unit.

The development agent holding member is disposed to face an electrostatic latent image holding body (a photoconductive drum) in a predetermined development area. The development agent holding member has a development agent holding surface on which charged development agent is held and carried.

The upstream development agent transfer unit has an upstream transfer surface, which is disposed upstream relative to the development area in a moving direction of the development agent holding surface (i.e., in a rotational direction of the development roller) so as to face the development agent holding surface across a predetermined distance. The upstream development agent transfer unit is configured to generate an upstream transfer electric field (i.e., an electric field for transferring the development agent held on the upstream transfer surface from an upstream side to a downstream side in the moving direction of the development agent holding member).

The downstream development agent transfer unit has a downstream transfer surface, which is disposed downstream relative to the development area in the moving direction of the development agent holding surface so as to face the development agent holding surface across a predetermined distance. The upstream development agent transfer unit is configured to generate a downstream transfer electric field (i.e., an electric field for transferring the development agent held on the downstream transfer surface from an upstream side to a downstream side in the moving direction of the development agent holding member).

In the above configuration, the electric fields, for transferring the charged development agent from an upstream side to a downstream side in the moving direction of the development agent holding member, are generated in spaces on the upstream transfer surface and the downstream transfer surface. Thereby, the development agent is transferred, on each of the upstream transfer surface and the downstream transfer surface, from the upstream side to the downstream side in the moving direction of the development agent holding member.

The development agent, carried by the upstream development agent transfer unit, is transferred onto the development agent holding surface in a position where the upstream transfer surface faces the development agent holding surface.

Thereby, the development agent adheres to the development agent holding surface. Namely, the development agent is held and carried on the development agent holding surface.

A part of the development agent held on the development agent holding surface is supplied and consumed in the development area to develop an electrostatic latent image. In other words, when reaching the development area, the development agent held on the development agent holding surface partially adheres to positions, corresponding to the electrostatic latent image, on an electrostatic latent image holding surface that is a circumferential surface of the electrostatic latent image holding body.

The remaining part, of the development agent held on the development agent holding surface, which has not adhered to the electrostatic latent image holding surface (i.e., which has not been consumed in the development area), is retrieved by the downstream development agent transfer unit, and then transferred, on the downstream transfer surface, from the upstream side to the downstream side in the moving direction of the development agent holding surface.

SUMMARY

In order for a development agent supply device of this kind to supply the development agent to the intended device in a preferable manner, it is seriously required to make the development agent holding surface hold thereon adequately-charged development agent. In other words, it is needed to, as far as possible, prevent inadequately-charged development agent (i.e., development agent uncharged or charged with a small amount of electric charges) from being held on the development agent holding surface.

Aspects of the present invention are advantageous to provide one or more improved configurations for a development agent supply device that make it possible to prevent inadequately-charged development agent from being held on a development agent holding surface.

According to aspects of the present invention, a development agent supply device is provided that is configured to supply charged development agent to an intended device. The development agent supply device includes a development agent holding member that has a development agent holding surface formed to be a cylindrical circumferential surface parallel to a main scanning direction, the development agent holding member being configured to rotate around an axis parallel to the main scanning direction such that the development agent holding surface moves in a moving direction perpendicular to the main scanning direction and faces the intended device in a development agent supply position, and a casing formed to, when viewed in the main scanning direction, be elongated in a longitudinal direction that is substantially perpendicular to the main scanning direction and parallel to a horizontal direction. The casing includes an opening formed at a first end in the longitudinal direction of the casing, a first development agent storage section that is formed at a second end in the longitudinal direction in a bottom region of an internal space of the casing and configured to store development agent, and a second development agent storage section that is formed in a position adjacent to the first development agent storage section in the bottom region of the internal space of the casing and configured to store development agent. The casing accommodates the development agent holding member such that the development agent holding surface faces the intended device via the opening. The development agent supply device further includes a first electric-field transfer board having a development agent transfer surface facing down, the first electric-field transfer board being configured to transfer development agent with a traveling-wave electric field, along the development agent transfer surface in a development agent transfer direction that extends from the first development agent storage section to the opening, while making inadequately-charged development agent fall from the development agent transfer surface, the first electric-field transfer board facing the development agent holding surface at a downstream end in the development agent transfer direction so as to supply adequately-charged development agent to the development agent holding surface, and a development agent retrieving unit configured to agitate the development agent stored in the second development agent storage section and the inadequately-charged development agent falling from the development agent transfer surface and convey the agitated development agent to the first development agent storage section.

According to aspects of the present invention, further provided is an image forming apparatus, which includes a photoconductive body configured such that a development agent image is formed thereon, and a development agent supply device configured to supply charged development agent to the photoconductive body. The development agent supply device includes a development agent holding member that has a development agent holding surface formed to be a cylindrical circumferential surface parallel to a main scanning direction, the development agent holding member being configured to rotate around an axis parallel to the main scanning direction such that the development agent holding surface moves in a moving direction perpendicular to the main scanning direction and faces the photoconductive body in a development agent supply position, and a casing formed to, when viewed in the main scanning direction, be elongated in a longitudinal direction that is substantially perpendicular to the main scanning direction and parallel to a horizontal direction. The casing includes an opening formed at a first end in the longitudinal direction of the casing, a first development agent storage section that is formed at a second end in the longitudinal direction in a bottom region of an internal space of the casing and configured to store development agent, and a second development agent storage section that is formed in a position adjacent to the first development agent storage section in the bottom region of the internal space of the casing and configured to store development agent. The casing accommodates the development agent holding member such that the development agent holding surface faces the photoconductive body via the opening. The development agent supply device further includes a first electric-field transfer board having a development agent transfer surface facing down, the first electric-field transfer board being configured to transfer development agent with a traveling-wave electric field, along the development agent transfer surface in a development agent transfer direction that extends from the first development agent storage section to the opening, while making inadequately-charged development agent fall from the development agent transfer surface, the first electric-field transfer board facing the development agent holding surface at a downstream end in the development agent transfer direction so as to supply adequately-charged development agent to the development agent holding surface, and a development agent retrieving unit configured to agitate the development agent stored in the second development agent storage section and the inadequately-charged development agent falling from the development agent transfer surface and convey the agitated development agent to the first development agent storage section.

BRIEF DESCRIPTION OF THE ACCOMPANYING DRAWINGS

FIG. 1 is a cross-sectional side view schematically showing a configuration of an image forming apparatus having a toner supply device in an embodiment according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an embodiment according to aspects of the present invention will be described with reference to the accompany drawing.

<Configuration of Image Forming Apparatus>

As illustrated in FIG. 1, an image forming apparatus 1 includes a photoconductive drum 2 and a toner supply device 3.

On a circumferential surface of the photoconductive drum 2, an electrostatic latent image holding surface LS is formed as a cylindrical surface parallel to a main scanning direction (i.e., a Z-axis direction in FIG. 1). The electrostatic latent image holding surface LS is configured such that an electrostatic latent image is formed thereon in accordance with an electric potential distribution, using an electrification device (not shown) and a scanning unit (not shown). Further, the electrostatic latent image holding surface LS is configured to hold and carry toner T (dry-type development agent) in positions corresponding to the electrostatic latent image.

The photoconductive drum 2 is driven to rotate in a direction indicated by arrows in FIG. 1, around an axis parallel to the main scanning direction. Namely, the photoconductive drum 2 is configured such that the electrostatic latent image holding surface LS moves along an auxiliary scanning direction perpendicular to the main scanning direction.

The toner supply device 3 is disposed to be laterally adjacent to the photoconductive drum 2 and face the electrostatic latent image holding surface LS in a development position DP. The toner supply device 3 is configured to supply powdered toner T in a charged state onto the photoconductive drum 2 (the electrostatic latent image holding surface LS).

<<Toner Supply Device>>

As depicted in FIG. 1 that is a cross-sectional side view (a cross-sectional view along a plane with the main scanning direction as a normal line) of the toner supply device 3, a casing 31 of the toner supply device 3 is a box-shaped member that has a longitudinal direction along a horizontal direction (i.e., an X-axis direction in FIG. 1) perpendicular to the main scanning direction when viewed in the Z-axis direction.

At an end in the longitudinal direction of the casing 31, an opening 31*a* is formed. In other words, the opening 31*a* is provided at an end (hereinafter referred to as a first end) in the longitudinal direction of the casing 31 which first end faces the photoconductive drum 2.

A before-transferred toner storage section 31*b* is formed in a bottom region in an internal space of the casing 31 at the other end (hereinafter referred to as a second end) in the longitudinal direction of the casing 31. The before-transferred toner storage section 31*b* is a space that is formed substantially in the shape of an upward-open "C" when viewed in the Z-axis direction. The before-transferred toner storage section 31*b* is configured to accommodate toner T (immediately) before transferred by an electric field.

In the bottom region in the internal space of the casing 31, subsidiary toner storage sections 31*c* and 31*d* are formed to be adjacent to the before-transferred toner storage section 31*b*. The subsidiary toner storage section 31*d* is disposed closer to the opening 31*a* than the subsidiary toner storage section 31*c*. The subsidiary toner storage sections 31*c* and 31*d* are spaces each of which is formed substantially in the shape of an upward-open "C" when viewed in the Z-axis direction. The subsidiary toner storage sections 31*c* and 31*d* are connected with each other such that the toner T is transferred between the both ends of the casing 31 in the main scanning direction.

Between the before-transferred toner storage section 31*b* and the subsidiary toner storage section 31*c*, a partition wall 31*e* is formed along the main scanning direction. Further, between the subsidiary toner storage sections 31*c* and 31*d*, a partition wall 31*f* is formed along the main scanning direction. The partition wall 31*e* is lower than the partition wall 31*f*.

In the internal space of the casing 31, a shield member 31*g* is provided. The shield member 31*g* is a flat member disposed to divide the internal space of the casing 31 into a roller housing section 31*h* (i.e., a first room) and a remaining section (i.e., a second room) other than the roller housing section 31*h*. The roller housing section 31*h* is located at the first end, in the longitudinal direction of the casing 31, where the opening 31*a* is formed. Inside the roller housing section 31*h*, a development roller 32 is housed. Namely, the shield member 31*g* is configured to shield the development roller 32 from a space where the toner T is stored (i.e., from the remaining section other than the roller housing section 31*h* inside the casing 31).

The casing 31 includes a bottom plate 31*j* that forms the before-transferred toner storage section 31*b* and the subsidiary storage sections 31*c* and 31*d*, a top plate 31*k* provided to face the bottom plate 31*j*, the aforementioned shield member 31*g*, and a pair of side plates (not shown). The bottom plate 31*j* and the top plate 31*k* are smoothly connected with each other, substantially in the shape of an arc, at the second end in the longitudinal direction of the casing 31, when viewed in the Z-axis direction.

The development roller 32 is a roller-shaped member having a toner holding surface 32*a* which is a cylindrical circumferential surface parallel to the main scanning direction. The development roller 32 is disposed to face the photoconductive drum 2 via the opening 31*a*. Namely, the development roller 32 is housed in the casing 31 in a state where the toner holding surface 32*a* thereof is exposed to the outside of the casing 31 via the opening 31*a* so as to face the photoconductive drum 2.

In the development position DP, a gap is provided of a predetermined distance between the toner holding surface 32*a* of the development roller 32 and the electrostatic latent image holding surface LS of the photoconductive drum 2. Namely, in the development position DP, the development roller 32 is disposed to face the photoconductive drum 2 in closest proximity to the photoconductive drum 2.

The development roller 32 is rotatably supported by the roller housing section 31*h* of the casing 31. Specifically, the development roller 32 is configured to supply, to the development position DP, the toner T held on the toner holding surface 32*a*, by moving the toner holding surface 32*a* in a direction perpendicular to the main scanning direction while rotating around an axis parallel to the main scanning direction.

An electric-field transfer board 33 is incorporated in the casing 31. In the embodiment, the electric-field transfer board 33 includes a main electric-field transfer board 33*a*, a subsidiary electric-field transfer board 33*b*, and a retrieving electric-field transfer board 33*c*. Further, the electric-field transfer board 33 is configured in the same fashion as a flexible printed-circuit board. Specifically, the electric-field transfer board 33 is provided with a plurality of transfer electrodes 33*e*. The transfer electrodes 33*e* are formed with linear wiring patterns elongated in the main scanning direction, and arranged at intervals of a predetermined distance along the auxiliary scanning direction perpendicular to the main scanning direction. The electric-field transfer board 33 is configured to, when a multiple-phase alternating-current voltage is applied thereto, transfer toner T along a toner transfer surface TTS (a surface of the electric-field transfer board 33) in a toner transfer direction TTD.

The main electric-field transfer board 33*a* is fixed onto an inner wall surface of the top plate 31*k* of the casing 31 such that the toner transfer surface TTS is provided along the longitudinal direction of the casing 31 so as to face down. Namely, the toner transfer surface TTS of the main electric-field transfer board 33*a* is formed to make inadequately-charged toner T fall while transferring the toner T with a traveling-wave electric field in the toner transfer direction TTD that extends from the before-transferred toner storage section 31*b* to the opening 31*a*. Further, the main electric-field transfer board 33*a* is configured such that a downstream end thereof in the toner transfer direction TTD extends up to a position to face the toner holding surface 32*a* (specifically, up to a position just in front of the opening 31*a*) so as to supply adequately-charged toner T to the toner holding surface 32*a*.

The subsidiary electric-field transfer board 33*b* is fixed onto an inner wall surface of the bottom plate 31*j* of the casing 31 at the second end in the longitudinal direction of the casing 31. The subsidiary electric-field transfer board 33*b* is configured such that an upstream end thereof in the toner transfer direction TTD is immersed into the toner T stored in the before-transferred toner storage section 31*b*.

Further, a downstream end of the subsidiary electric-field transfer board 33*b* in the toner transfer direction TTD is connected with an upstream end of the main electric-field transfer board 33*a* in the toner transfer direction TTD. Namely, the toner transfer surface TTS of the subsidiary electric-field transfer board 33*b* is formed with a slanted surface that extends up toward the upstream end of the main electric-field transfer board 33*a* in the toner transfer direction TTD. Further, the subsidiary electric-field transfer board 33*b* is configured to supply the toner T to the main electric-field transfer board 33*a* by transferring the toner T stored in the before-transferred toner storage section 31*b* toward the main electric-field transfer board 33*a* with the traveling-wave electric field. It is noted that the main electric-field transfer board 33*a* (i.e., first electric-field transfer board) is formed integrally with the subsidiary electric-field transfer board 33*b* (i.e., second electric-field transfer board).

Additionally, in the embodiment, the electric-field transfer board 33 (i.e., the main electric-field transfer board 33*a* and the subsidiary electric-field transfer board 33*b*) is configured such that the upstream end of a horizontally-extending flat portion of the main electric-field transfer board 33*a* in the toner transfer direction TTD does not overlap the upstream end of the subsidiary electric-field transfer board 33*b* in the toner transfer direction TTD (i.e., the most-upstream end of the electric-field transfer board 33 in the toner transfer direction TTD) when viewed in a vertical direction (i.e., in a Y-axis direction shown in FIG. 1).

The retrieving electric-field transfer board 33*c* is disposed on a surface of the shield member 31*g* that faces the development roller 32. The retrieving electric-field transfer board 33*c* is configured to retrieve the toner T, which remains on the toner holding surface 32*a*, from the toner holding surface 32*a* at a downstream side relative to the opening 31*a* in the moving direction of the toner holding surface 32*a*. Further, the retrieving electric-field transfer board 33*c* is configured to transfer the retrieved toner T down to the subsidiary toner storage section 31*d* with the traveling-wave electric field.

An agitator 34 is disposed in a position corresponding to the before-transferred toner storage section 31*b*, at the bottom of the casing 31. In other words, the agitator 34 is incorporated in the before-transferred toner storage section 31*b*. The agitator 34 includes a shaft 34*a* configured as a rotational axis along the main scanning direction, and an agitating bar 34*b* formed outside the shaft 34*a* in a radial direction of the shaft 34*a*. The agitating bar 34*b* is a bar-shaped member elongated along the shaft 34*a*, and typically provided to be parallel to the shaft 34*a*. The agitator 34 is configured to, when the shaft 34*a* is driven to rotate, agitate the toner T in the before-transferred toner storage section 31*b*.

A first auger 35 and a second auger 36 are disposed respectively in the subsidiary toner storage sections 31*c* and 31*d* that are disposed adjacent to the before-transferred toner storage section 31*b* at the bottom of the casing 31. The first auger 35 and the second auger 36 are configured to agitate the toner T previously stored in the subsidiary toner storage sections 31*c* and 31*d* and the toner T coming down from the toner transfer surface TTS of the main electric-field transfer board 33*a*, and to convey the toner T to the before-transferred toner storage section 31*b*.

The first auger 35 is disposed in the subsidiary toner storage section 31*c*. The first auger 35 includes a shaft 351 configured as a rotational axis along the main scanning direction, and a corkscrew blade 352 formed around the shaft 351. The first auger 35 is configured to, when the shaft 351 is driven to rotate, convey the toner T in a first direction (e.g., a positive direction along the Z-axis in FIG. 1) parallel to the main scanning direction while agitating the toner T in the subsidiary toner storage section 31*c*.

The second auger 36 is disposed in the subsidiary toner storage section 31*d*. The second auger 36 includes a shaft 361 configured as a rotational axis along the main scanning direction, and a corkscrew blade 362 formed around the shaft 361. The second auger 36 is configured to, when the shaft 361 is driven to rotate, convey the toner T in a second direction (e.g., a negative direction along the Z-axis in FIG. 1) parallel to the main scanning direction while agitating the toner T in the subsidiary toner storage section 31*d*.

<Operations>

Subsequently, an explanation will be provided about a general overview of operations of the image forming apparatus configured as above, with reference to the accompanying drawing.

At the upstream end (which is immersed in the toner T stored in the before-transferred toner storage section 31*b*) of the subsidiary electric-field transfer board 33*b* in the toner transfer direction TTD, transferring of the toner T is begun with the traveling-wave electric field. Namely, a part of the toner T stored in the before-transferred toner storage section 31*b* while being agitated by the agitator 34, which part is close to the toner transfer surface TTS at the upstream end of the subsidiary electric-field transfer board 33*b* in the toner transfer direction TTD, is driven by the traveling-wave electric field generated by the subsidiary electric-field transfer board 33*b*, so as to go up along the slanted surface of the toner transfer surface TTS of the subsidiary electric-field transfer board 33*b*.

Then, the toner T is transferred from the downstream end of the subsidiary electric-field transfer board 33*b* in the toner transfer direction TTD to the upstream end of the main electric-field transfer board 33*a* in the toner transfer direction TTD. Thereby, the toner T is supplied from the subsidiary electric-field transfer board 33*b* to the main electric-field transfer board 33*a*. At a joint between the downstream end of the subsidiary electric-field transfer board 33*b* in the toner transfer direction TTD and the upstream end of the main electric-field transfer board 33*a* in the toner transfer direction TTD, the toner T is conveyed up substantially in the vertical direction (i.e., in the Y-axis direction in FIG. 1).

The toner T, which is supplied from the subsidiary electric-field transfer board 33*b* to the main electric-field transfer board 33*a*, is conveyed to the opening 31*a* along the down-facing toner transfer surface TTS of the main electric-field transfer board 33*a*. The toner T, which is conveyed along the toner transfer surface TTS (provided along the longitudinal direction of the casing 31), reaches the roller housing section 31*h* at the downstream end of the main electric-field transfer board 33*a* in the toner transfer direction TTD, and supplied to the toner holding surface 32*a*. Thereby, the toner T is held and carried on the toner holding surface 32*a*. The toner T, which is held on the toner holding surface 32*a*, reaches the development position DP when the toner holding surface 32*a* moves concurrently with rotation of the development roller 32. Thus, in the development position DP, the toner T is supplied to the photoconductive drum 2 (the electrostatic latent image holding surface LS).

In the middle to transfer the toner T from the before-transferred toner storage section 31*b* to the roller housing section 31*h*, inadequately-charged toner T (i.e., toner T uncharged or charged with a small amount of electric charges) drops off. Specifically, while the toner T is being transferred along the down-facing toner transfer surface TTS of the main electric-field transfer board 33*a*, inadequately-charged toner T falls into the before-transferred toner storage section 31*b* or the subsidiary toner storage section 31*c*.

Accordingly, most of the toner T that reaches the roller housing section 31*h* is adequately-charged toner T. Further, the internal space of the casing 31 is divided in a shielding manner by the shield member 31*g* into the roller housing section 31*h* and the remaining section (where the toner T falls into the before-transferred toner storage section 31*b* and the subsidiary toner storage section 31*c*). Hence, it is possible to prevent the inadequately-charged toner T, which is falling from the down-facing toner transfer surface TTS of the main electric-field transfer board 33*a*, from adhering to the toner holding surface 32*a*, in a preferable manner.

Further, in the embodiment, the electric-field transfer board 33 is configured such that the upstream end of the subsidiary electric-field transfer board 33*b* in the toner transfer direction TTD where the toner T is driven to be transferred does not overlap the upstream end of a horizontally-extending flat portion of the main electric-field transfer board 33*a* in the toner transfer direction TTD when viewed in the vertical direction (i.e., in the Y-axis direction shown in FIG. 1). Therefore, it is possible to prevent the inadequately-charged toner T, which drops off the down-facing toner transfer surface TTS of the main electric-field transfer board 33*a*, from falling to the upstream end of the subsidiary electric-field transfer board 33*b* in the toner transfer direction TTD where the toner T is driven to be transferred. Thus, the electric-field transfer board 33 can always transfer adequately-charged toner T (excluding the inadequately-charged toner T which has fell while being transferred).

The toner T, which remains on the toner holding surface 32*a* at a downstream side relative to the opening 31*a* in the moving direction of the toner holding surface 32*a* (i.e., which has not been transferred onto the photoconductive drum 2 in the development position DP), is retrieved from the toner holding surface 32*a* by the retrieving electric-field transfer board 33*c*, so as to avoid generation of a ghost image. Thus, the toner T, which is retrieved from the toner holding surface 32*a*, is conveyed down to the subsidiary toner storage section 31*d* by the traveling-wave electric field, and falls into the subsidiary toner storage section 31*d*.

The toner T which is previously stored in the subsidiary toner storage sections 31*c* and 31*d* and the toner T which has come down into the subsidiary toner storage sections 31*c* and 31*d* are evenly agitated while being made reciprocate in the main scanning direction by the first auger 35 and the second auger 36. Thus, a part of the toner T agitated flows in the before-transferred toner storage section 31*b* over the partition wall 31*e*. In other words, the toner T is conveyed into the before-transferred toner storage section 31*b* while being agitated by the first auger 35 and the second auger 36 in the subsidiary toner storage sections 31*c* and 31*d*.

As described above, according to the low-profile toner supply device in the embodiment that is elongated substantially in the horizontal direction, inadequately-charged toner T drops off the toner transfer surface TTS in the middle to be conveyed along the toner transfer surface TTS. Thereby, it is possible to prevent the inadequately-charged toner T from being held on the toner holding surface 32*a*. Additionally, the toner T coming down from the toner transfer surface TTS is agitated in a preferable fashion in the subsidiary toner storage sections 31*c* and 31*d*, and again fed into the before-transferred toner storage section 31*b*.

In addition, the retrieving electric-field transfer board 33*c* for preventing generation of a ghost image is provided on the surface, which faces the development roller 32, of the shield member 31*g* configured to shield the development roller 32 from the inadequately-charged toner T which is falling in the casing 31. Thereby, it is possible to concurrently prevent the inadequately-charged toner T which is falling in the casing 31 from adhering onto the toner holding surface 32*a* and prevent generation of a ghost image.

Thus, according to the embodiment, the low-profile toner supply device 3 is provided that is elongated substantially in the horizontal direction and configured to supply the toner T to the photoconductive drum 2 in a preferable manner.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible.

An intended device to which the toner T be supplied is not limited to the photoconductive drum 2, but may include a plate-shaped or endless-belt-shaped photoconductive body, and an aperture electrode for a toner-jet type image forming apparatus. In other words, aspects of the present invention may be applied to image forming apparatuses using methods other than the electrophotographic method (e.g., the aforementioned toner-jet method using no photoconductive body, an ion flow method, and a multi-stylus electrode method).

The before-transferred toner storage section 31*b* may be formed up to substantially the center in the longitudinal direction of the casing 31. Further, the toner supply device 3 may be configured without the partition wall 31*f*. Moreover, the shield member 31*g* may be omitted partially or entirely.

The main electric-field transfer board 33*a* and/or the subsidiary electric-field transfer board 33*b* may be fixed to the inner wall surface of the casing 31 as exemplified in the aforementioned embodiment, or may be formed integrally with the casing 31. Namely, the main electric-field transfer board 33*a* and/or the subsidiary electric-field transfer board 33*b* may be formed with the transfer electrodes 33*e* embedded in the inner wall surface of the casing 31.

With respect to existence/nonexistence and the detailed configuration of the agitator 34, and the number and the configuration of the augers 35 and 36, they are not limited to those as exemplified in the aforementioned embodiment. For example, the bar 34*b* of the agitator 34 may be made of a film elongated along the shaft 34*a*. In this case, the film may have a free end and a supported end in a radial direction of the shaft 34*a* and the supported end may be fixed to the shaft 34*a*.

What is claimed is:

1. A development agent supply device configured to supply charged development agent to an intended device, comprising:

a development agent holding member that comprises a development agent holding surface formed to be a cylindrical circumferential surface parallel to a main scanning direction, the development agent holding member being configured to rotate around an axis parallel to the main scanning direction such that the development agent holding surface moves in a moving direction perpendicular to the main scanning direction and faces the intended device in a development agent supply position;

a casing formed to, when viewed in the main scanning direction, be elongated in a longitudinal direction that is substantially perpendicular to the main scanning direction and parallel to a horizontal direction, wherein the casing comprises:

an opening formed at a first end in the longitudinal direction of the casing;

a first development agent storage section that is formed at a second end in the longitudinal direction in a bottom region of an internal space of the casing and configured to store development agent; and a second development agent storage section that is formed in a position adjacent to the first development agent storage section in the bottom region of the internal space of the casing and configured to store development agent, and wherein the casing accommodates the development agent holding member such that the development agent holding surface faces the intended device via the opening;

a first electric-field transfer board comprising a development agent transfer surface facing down, the first electric-field transfer board being configured to transfer development agent with a traveling-wave electric field, along the development agent transfer surface in a development agent transfer direction that extends from the first development agent storage section to the opening, while making inadequately-charged development agent fall from the development agent transfer surface, the first electric-field transfer board facing the development agent holding surface at a downstream end in the development agent transfer direction so as to supply adequately-charged development agent to the development agent holding surface; and a development agent retrieving unit configured to agitate the development agent stored in the second development agent storage section and the inadequately-charged development agent falling from the development agent transfer surface and convey the agitated development agent to the first development agent storage section, the development agent retrieving unit comprising a first and second auger each comprising a shaft formed along the main scanning direction and a corkscrew blade formed around the shaft, the first auger being configured to rotate around the shaft and to move the development agent in the second development agent storage section in a first direction along the main scanning direction, the second auger being disposed parallel to the first auger and adjacent to the first auger in the longitudinal direction of the casing, the second auger being configured rotate around the shaft and to move the development agent in the second development agent storage section in a second direction opposite to the first direction.

2. The development agent supply device according to claim 1, further comprising an agitator that comprises:

a rotational shaft formed along the main scanning direction; and an agitating bar formed outside the rotational shaft in a radial direction of the rotational shaft, wherein the agitator is configured to rotate around the rotational shaft and agitate the development agent in the first development agent storage section.

3. The development agent supply device according to claim 1, further comprising an agitator that comprises:

a rotational shaft formed along the main scanning direction; and an agitating bar formed outside the rotational shaft in a radial direction of the rotational shaft, wherein the agitator is configured to rotate around the rotational shaft and agitate the development agent in the first development agent storage section.

4. The development agent supply device according to claim 1, further comprising a shield member formed to divide an internal space of the casing into a first room and a second room, wherein the first room is formed at the first end in the longitudinal direction of the casing so as to accommodate the development agent holding member, wherein the second room is formed at the second end in the longitudinal direction of the casing, and wherein the shield member is configured to shield the development agent holding member from the second room.

5. The development agent supply device according to claim 1, further comprising a retrieving electric-field transfer board provided on a surface of the shield member which surface faces the development agent holding member, wherein the retrieving electric-field transfer board is configured to retrieve development agent remaining on the development agent holding surface, at a downstream side relative to the opening in the moving direction of the development agent holding surface, and to convey the retrieved development agent to the development agent retrieving unit with a traveling-wave electric field.

6. The development agent supply device according to claim 1, wherein the first electric-field transfer board is fixed to a top plate of the casing.

7. The development agent supply device according to claim 1, further comprising a second electric-field transfer board configured to transfer the development agent stored in the first development agent storage section to the first electric-field transfer board with a traveling-wave electric field, and to supply the development agent to the first electric-field transfer board.

8. The development agent supply device according to claim 7, wherein the second electric-field transfer board is formed integrally with the first electric-field transfer board.

9. An image forming apparatus comprising:

a photoconductive body configured such that a development agent image is formed thereon; and a development agent supply device configured to supply charged development agent to the photoconductive body, wherein the development agent supply device comprises:

a development agent holding member that comprises a development agent holding surface formed to be a cylindrical circumferential surface parallel to a main scanning direction, the development agent holding member being configured to rotate around an axis parallel to the main scanning direction such that the development agent holding surface moves in a moving direction perpendicular to the main scanning direction and faces the photoconductive body in a development agent supply position;

a casing formed to, when viewed in the main scanning direction, be elongated in a longitudinal direction that is substantially perpendicular to the main scanning direction and parallel to a horizontal direction, wherein the casing comprises:

an opening formed at a first end in the longitudinal direction of the casing;

a first development agent storage section that is formed at a second end in the longitudinal direction in a bottom region of an internal space of the casing and configured to store development agent; and a second development agent storage section that is formed in a position adjacent to the first development agent storage section in the bottom region of the internal space of the casing and configured to store development agent, and wherein the casing accommodates the development agent holding member such that the development agent holding surface faces the photoconductive body via the opening;

a first electric-field transfer board comprising a development agent transfer surface facing down, the first electric-field transfer board being configured to transfer development agent with a traveling-wave electric field, along the development agent transfer surface in a development agent transfer direction that extends from the first development agent storage section to the opening, while making inadequately-charged development agent fall from the development agent transfer surface, the first electric-field transfer board facing the development agent holding surface at a downstream end in the development agent transfer direction so as to supply adequately-charged development agent to the development agent holding surface; and a development agent retrieving unit configured to agitate the development agent stored in the second development agent storage section and the inadequately-charged development agent falling from the development agent transfer surface and convey the agitated development agent to the first development agent storage section, the development agent retrieving unit comprising a first and second auger each comprising a shaft formed along the main scanning direction and a corkscrew blade formed around the shaft, the first auger being configured to rotate around the shaft and to move the development agent in the second development agent storage section in a first direction along the main scanning direction, the second auger being disposed parallel to the first auger and adjacent to the first auger in the longitudinal direction of the casing, the second auger being configured rotate around the shaft and to move the development agent in the second development agent storage section in a second direction opposite to the first direction.

10. The image forming apparatus according to claim 9, wherein the development agent supply device further comprises an agitator that comprises:

a rotational shaft formed along the main scanning direction; and an agitating bar formed outside the rotational shaft in a radial direction of the rotational shaft, and wherein the agitator is configured to rotate around the rotational shaft and agitate the development agent in the first development agent storage section.

11. The image forming apparatus according to claim 9, wherein the development agent supply device further comprises an agitator that comprises:

a rotational shaft formed along the main scanning direction; and an agitating bar formed outside the rotational shaft in a radial direction of the rotational shaft, and wherein the agitator is configured to rotate around the rotational shaft and agitate the development agent in the first development agent storage section.

12. The image forming apparatus according to claim 9, wherein the development agent supply device further comprises a shield member formed to divide an internal space of the casing into a first room and a second room, wherein the first room is formed at the first end in the longitudinal direction of the casing so as to accommodate the development agent holding member, wherein the second room is formed at the second end in the longitudinal direction of the casing, and wherein the shield member is configured to shield the development agent holding member from the second room.

13. The image forming apparatus according to claim 12, wherein the development agent supply device further comprises a retrieving electric-field transfer board provided on a surface of the shield member which surface faces the development agent holding member, and wherein the retrieving electric-field transfer board is configured to retrieve development agent remaining on the development agent holding surface, at a downstream side relative to the opening in the moving direction of the development agent holding surface, and to convey the retrieved development agent to the development agent retrieving unit with a traveling-wave electric field.

14. The image forming apparatus according to claim 9, wherein the first electric-field transfer board is fixed to a top plate of the casing.

15. The image forming apparatus according to claim 9, wherein the development agent supply device further comprises a second electric-field transfer board configured to transfer the development agent stored in the first development agent storage section to the first electric-field transfer board with a traveling-wave electric field, and to supply the development agent to the first electric-field transfer board.

16. The image forming apparatus according to claim 15, wherein the second electric-field transfer board is formed integrally with the first electric-field transfer board.

* * * * *